US009541034B2

(12) United States Patent
Dettloff

(10) Patent No.: US 9,541,034 B2
(45) Date of Patent: Jan. 10, 2017

(54) EGR DEVICE HAVING DIFFUSING DEVICE AND EGR MIXER FOR EGR DEVICE

(71) Applicants: DENSO International America, Inc., Southfield, MI (US); DENSO CORPORATION, Kariya, Aichi-pref. (JP)

(72) Inventor: Ian Dettloff, Westland, MI (US)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 118 days.

(21) Appl. No.: 14/561,308

(22) Filed: Dec. 5, 2014

(65) Prior Publication Data

US 2016/0160804 A1 Jun. 9, 2016

(51) Int. Cl.
*F02M 25/07* (2006.01)

(52) U.S. Cl.
CPC ..... *F02M 25/0722* (2013.01); *F02M 26/19* (2016.02)

(58) Field of Classification Search
CPC ..... F02M 26/17; F02M 26/19; F02M 25/072; F02M 25/0722; F02M 25/07; F02M 26/00
See application file for complete search history.

(56) References Cited

U.S. PATENT DOCUMENTS

2007/0271920 A1 11/2007 Marsal et al.
2012/0017880 A1* 1/2012 van Hal ..... F02M 35/10052 123/568.11
2012/0090581 A1* 4/2012 De Almeida ..... F02M 25/0722 123/568.11
2012/0180478 A1 7/2012 Johnson et al.

FOREIGN PATENT DOCUMENTS

WO 2013-055361 A1 4/2013

* cited by examiner

*Primary Examiner* — Jacob Amick

(57) ABSTRACT

A housing has an housing body. An inner pipe is accommodated in the housing body. The inner pipe defines an inner passage internally. The inner pipe defines an annular passage externally with the housing body. The inner pipe has through holes 68 communicating the inner passage with the annular passage. The housing internally defines an EGR channel communicating with the annular passage. The EGR channel accommodates a diffusing device 60 partitioning the EGR channel.

19 Claims, 8 Drawing Sheets

EGR DEVICE HAVING DIFFUSING DEVICE AND EGR MIXER FOR EGR DEVICE

TECHNICAL FIELD

The present disclosure relates to an EGR device having a diffusing device for an internal combustion engine of a vehicle. The present disclosure further relates to an EGR mixer for the EGR device.

BACKGROUND

A vehicle may be equipped with an exhaust gas recirculation system (EGR system). The EGR system is to reduce emission contained in exhaust gas discharged from an internal combustion engine. The EGR system may recirculate a part of exhaust gas into fresh air to produce mixture gas containing recirculated exhaust gas and fresh air. Recirculated exhaust gas may be unevenly mixed with fresh air to reduce combustion efficiency of the engine consequently.

SUMMARY

The present disclosure addresses the above-described concerns.

According to an aspect of the preset disclosure, an EGR device comprises a housing defining an inner passage internally and having an EGR inlet. The EGR device further comprises a diffusing device extended from the EGR inlet into the inner passage. The diffusing device is a hollow member having at least one wall, a root end, and a tip end defining an interior. The at least one wall has a plurality of through holes communicating the interior with the inner passage. The tip end is twisted relative to the root end.

According to another aspect of the preset disclosure, an EGR mixer is configured to be accommodated in a housing of an EGR device. The housing defines an inner passage internally and having an EGR inlet. The EGR mixer comprises a diffusing device body configured to be extended from the EGR inlet into the inner passage. The diffusing device body is a hollow member having a wall, a root end, and a tip end defining an interior. The wall has a plurality of through holes configured to communicate the interior with the inner passage. The tip end is twisted relative to the root end.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

Figure 1:
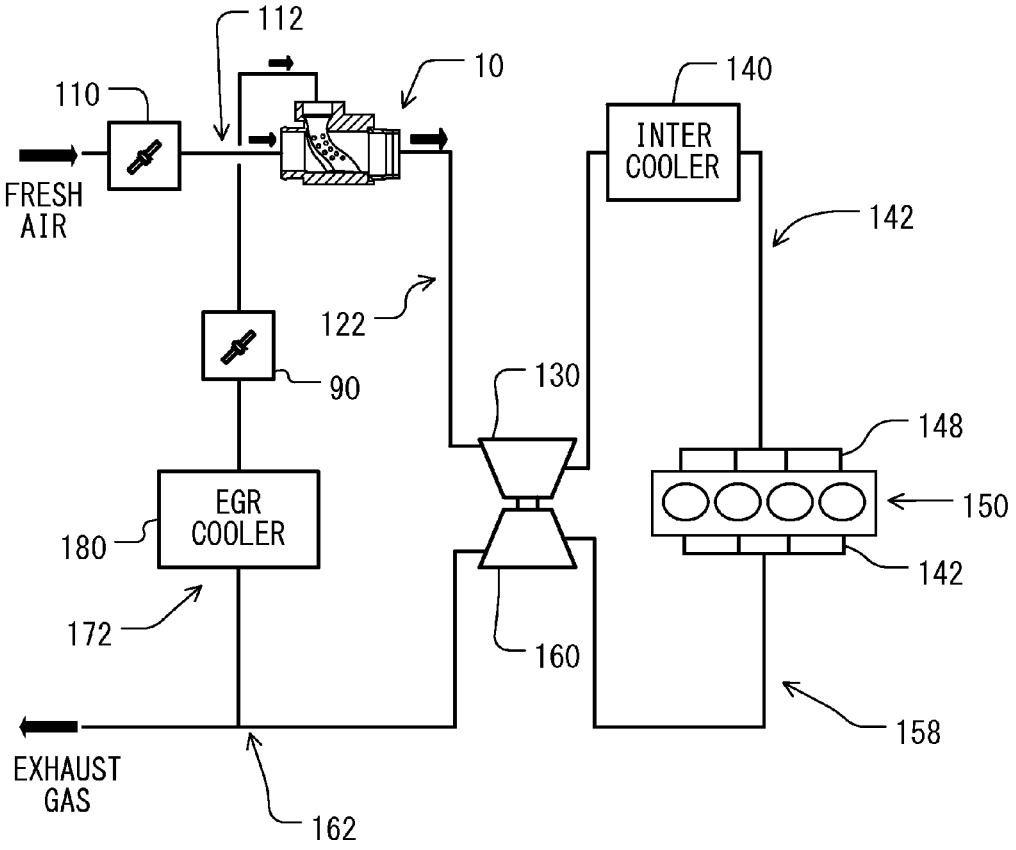
FIG. 1 is a block diagram showing an EGR system for an internal combustion engine of a vehicle.

In the following description, a radial direction is along an arrow represented by "RADIAL" in drawing(s). An axial direction is along an arrow represented by "AXIAL" in drawing(s). A circumferential direction is along an arrow represented by "CIRCUMFERENTIAL" in drawing(s). A vertical direction is along an arrow represented by "VERTICAL" in drawing(s). A horizontal direction is along an arrow represented by "HORIZONTAL" in drawing(s). A width direction is along an arrow represented by "WIDTH" in drawing(s). A length direction is along an arrow represented by "LENGTH" in drawing(s). A flow direction is along an arrow represented by "FLOW" in drawing(s).

As follows, a first embodiment of the present disclosure will be described with reference to FIGS. 1 to 7. As shown FIG. 1, according to the present example, an internal combustion engine 150 is connected with an intake manifold 148 and an exhaust manifold 142.

The engine 150 is combined with an intake and exhaust system. The intake and exhaust system includes an intake valve 110, an intake passage 112, an EGR device 10, a mixture passage 122, a turbocharger including a compressor 130 and a turbine 160, a charge air passage 142, and an intercooler 140. The intake and exhaust system further includes a combustion gas passage 158, an exhaust passage 162, an EGR passage 172, an EGR cooler 180, and an EGR valve 90.

The intake passage 112 is equipped with the intake valve 110. The intake passage 112 is connected with the EGR device 10. The EGR device 10 is connected with the compressor 130 through the mixture passage 122. The compressor 130 is connected with the intake manifold 148 through the charge air passage 142. The charge air passage 142 is equipped with the intercooler 140. The exhaust manifold 142 is connected with the turbine 160 through the combustion gas passage 158. The turbine 160 is connected with the exhaust passage 162. The EGR passage 172 is branched from the exhaust passage 162 and connected with the EGR device 10. The EGR passage 172 is equipped with the EGR cooler 180 and the EGR valve 90.

The intake passage 112 conducts fresh air from the outside of the vehicle through the intake valve 110 into the EGR device 10. The intake valve 110 regulates a quantity of fresh air flowing through the intake passage 112 into the EGR device 10. The EGR device 10 draws fresh air from the intake passage 112 and draws exhaust gas from the exhaust passage 162 through the EGR passage 172. The EGR device 10 includes an EGR mixer to blend the drawn fresh air with the drawn exhaust gas to produce mixture gas. The mixture passage 122 conducts the mixture gas from the EGR device 10 into the compressor 130.

The compressor 130 is rotatably connected with the turbine 160 via a common axis. The compressor 130 is driven by the turbine 160 to compress the mixture gas. The charge air passage 142 conducts the compressed mixture gas to the intake manifold 148. The intercooler 140 is a heat exchanger to cool the compressed mixture gas conducted through the charge air passage 142.

The engine 150 draws the cooled mixture gas. The engine 150 forms air-fuel mixture with the drawn mixture gas and injected fuel in each cylinder and burns the air-fuel mixture in the cylinder to drive a piston in the cylinder. The engine 150 emits combustion gas (exhaust gas) through the exhaust manifold 142 into the combustion gas passage 158. The combustion gas passage 158 conducts the combustion gas into the turbine 160. The turbine 160 is driven by the exhaust gas to drive the compressor 130 thereby to cause the compressor 130 to compress mixture gas and to press-feed the compressed mixture gas through the charge air passage 142 and the intercooler 140 into the engine 150.

The exhaust passage 162 conducts exhaust gas (combustion gas) from the turbine 160 to the outside of the vehicle. The EGR passage 172 is branched from the exhaust passage 162 at the downstream side of the turbine 160 to recirculate a part of exhaust gas from the exhaust passage 162 into the EGR device 10. The EGR cooler 180 is a heat exchanger to cool exhaust gas flowing though the EGR passage 172 into the EGR device 10. The EGR device 10 is located at a connection among the intake passage 112, the EGR passage 172, and the mixture passage 122. The EGR passage 172 is merged with the intake passage 112 in the EGR device 10. The EGR valve 90 regulates a quantity of EGR gas recirculated through the EGR passage 172 into the EGR mixer.

As described above, the EGR system is configured to recirculate a part of exhaust gas from the exhaust passage 162 into the intake passage 112. The circulated exhaust gas may contain oxygen at a lower percentage compared with oxygen contained in fresh air. Therefore, circulated exhaust gas may dilute mixture of exhaust gas and fresh air thereby to reduce peak temperature of combustion gas when burned in the combustion chamber of the engine 150. In this way, the EGR system may reduce oxidization of nitrogen, which is caused under high temperature, thereby to reduce nitrogen oxide (NOx) occurring in the combustion chamber.

Figure 2:
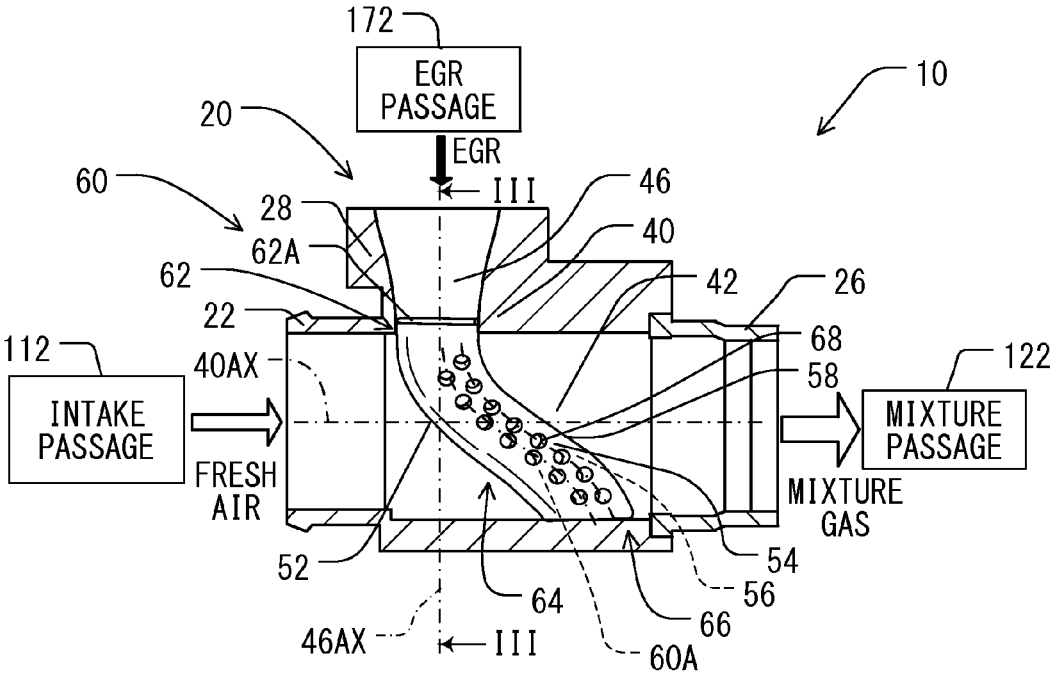
FIG. 2 is a partially sectional view showing an EGR device for the EGR system, according to a first embodiment.
Figure 2:
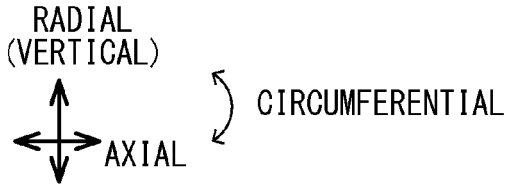
Figure 3:
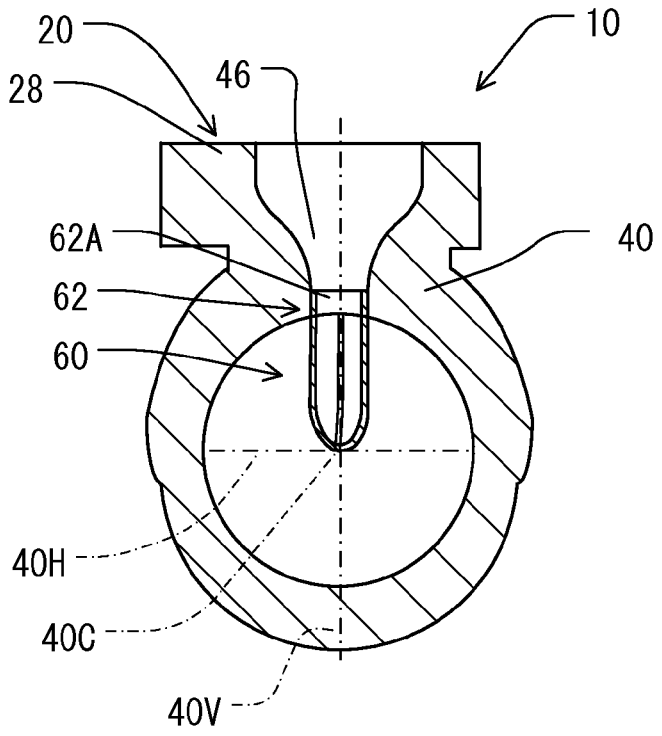
FIG. 3 is a sectional view showing the EGR device, the sectional view corresponding to a section taken along the line III-III in FIG. 2.
Figure 3:
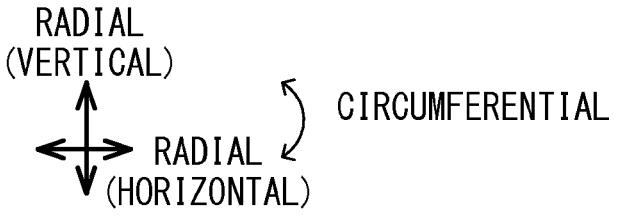
Figure 4:
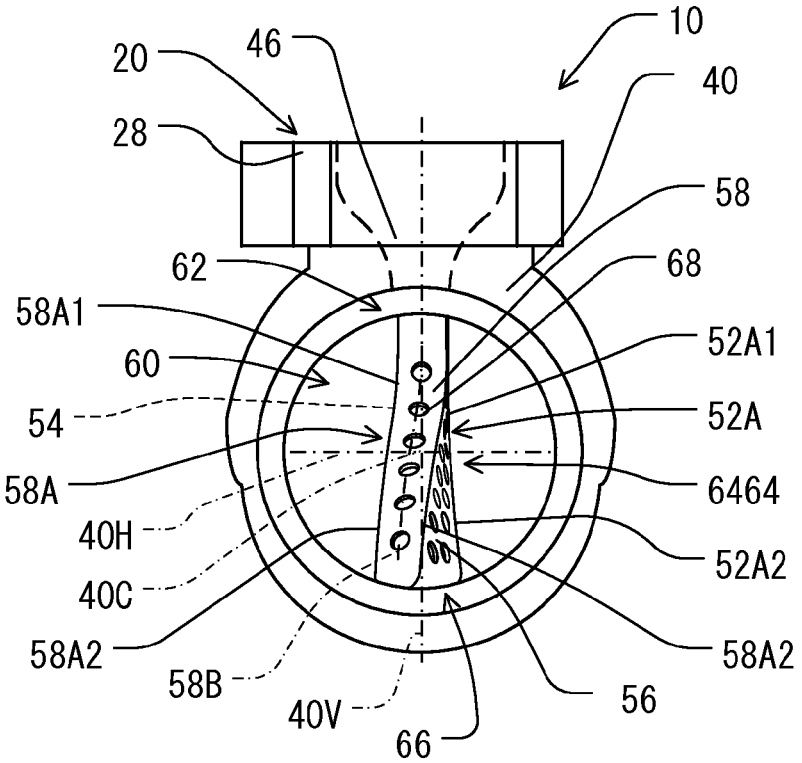
FIG. 4 is a view showing the EGR device viewed from a downstream side.
Figure 4:
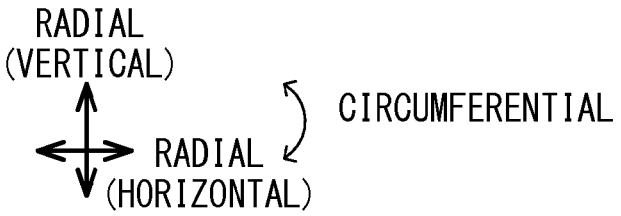

Subsequently, the configuration of the EGR device 10 will be described in detail. As shown in FIGS. 2 to 4, the EGR device 10 includes a housing 20 accommodating a diffusing device (diffusing device body) 60. The diffusing device 60 may function as an EGR mixer. The housing 20 and the diffusing device 60 are formed of a metallic material such as stainless steel and/or an aluminum alloy.

The housing 20 includes an air inlet 22, a housing body 40, an outlet 26, and an EGR inlet 28. The air inlet 22 is connected with the intake passage 112. The outlet 26 is connected with the mixture passage 122. The housing body 40 is located between the air inlet 22 and the outlet 26. In the present example, the air inlet 22, the housing body 40, and the EGR inlet 28 are integrally formed with each other, and the outlet 26 is affixed to the housing body 40 by, for example, welding. The housing body 40 has an inner periphery, which defines an inner passage 42 communicated with the intake passage 112 and the mixture passage 122.

The EGR inlet 28 is connected with the EGR passage 172. The EGR inlet 28 defines an EGR channel 46 internally. The EGR channel 46 extends along the radial direction through the EGR inlet 28. The EGR channel 46 is directed substantially at 90 degrees relative to a center axis 40AX of the housing body 40. The EGR channel 46 is defined with a curvature surface, which is in a funnel shape gradually reducing in cross section toward the inner passage 42.

The diffusing device 60 is inserted through the EGR channel 46 into the inner passage 42. The diffusing device 60 is affixed to the housing 20 at a root end 62 (one end) by, for example, welding or crimping, such that an opening 62A of the diffusing device 60 is communicated with the EGR channel 46. The diffusing device 60 may be in contact with the inner periphery of the housing body 40 at a tip end 66 (other end). In this case, the diffusing device 60 may be supported at the root end 62 and the tip end 66.

The diffusing device 60 is projected from the EGR channel 46 radially inward into the inner passage 42. The diffusing device 60 is extended into the inner passage 42 and inclined from the EGR inlet 28 toward the downstream side. That is, the diffusing device 60 is inclined relative to a center axis 46 AX of the EGR channel 46.

The diffusing device 60 is a twisted hollow object having multiple through holes 68. The diffusing device 60 may be formed by, for example, deep-drawing a metallic plate into a bottomed hollow case, forming the through holes 68 on walls, and twisting the bottomed hollow case. Alternatively, the diffusing device 60 may be formed by, for example, forming twisted metallic plates, forming through holes 68 in the twisted plates, and combining the twisted plates by, for example, welding into the twisted hollow object. The diffusing device 60 may be formed by various methods such as injection molding or 3D-printing of a resin or metallic material.

The diffusing device 60 has an intermediate portion 64 between the root end 62 and the tip end 66. The intermediate portion 64 is formed with an upstream wall 52, lateral walls 54 and 56, and a downstream wall 58. The upstream wall 52 is located on the upstream side of the lateral walls 54 and 56 relative to the fresh air flow. The downstream wall 58 is located on the downstream side of the lateral walls 54 and 56 relative to the mixture gas flow. The root end 62, the intermediate portion 64, and the tip end 66 define an interior 60A inside the diffusing device 60. The interior 60A of the diffusing device 60 communicates with the EGR channel 46 through the opening 62A of the root end 62. The tip end 66 forms the bottomed end of the diffusing device 60. The tip end 66 has a convex cross section projected toward the inner periphery of the housing body 40. The tip end 66 may have a curvature along the inner periphery of the housing body 40 to enable the tip end 66 to be fitted to the housing body 40. The inner periphery of the housing body 40 may be equipped with a bracket and/or a dent to retain the tip end 66.

In FIG. 4, the housing body 40 has a cross section having a vertical center 40V, a horizontal center 40H, and a center point 40C, which is an intersection between the vertical center 40V and the horizontal center 40H. The downstream wall 58 has through holes 68 arranged in one row along an imaginary line 58B. The imaginary line 58B may be substantially in parallel with sidelines 58A of the downstream wall 58. The imaginary line 58B may be a centerline of the downstream wall 58 and may extend along the vertical center 40V at the root end 62 to be veered from the vertical center 40V toward the tip end 66.

Figure 5:
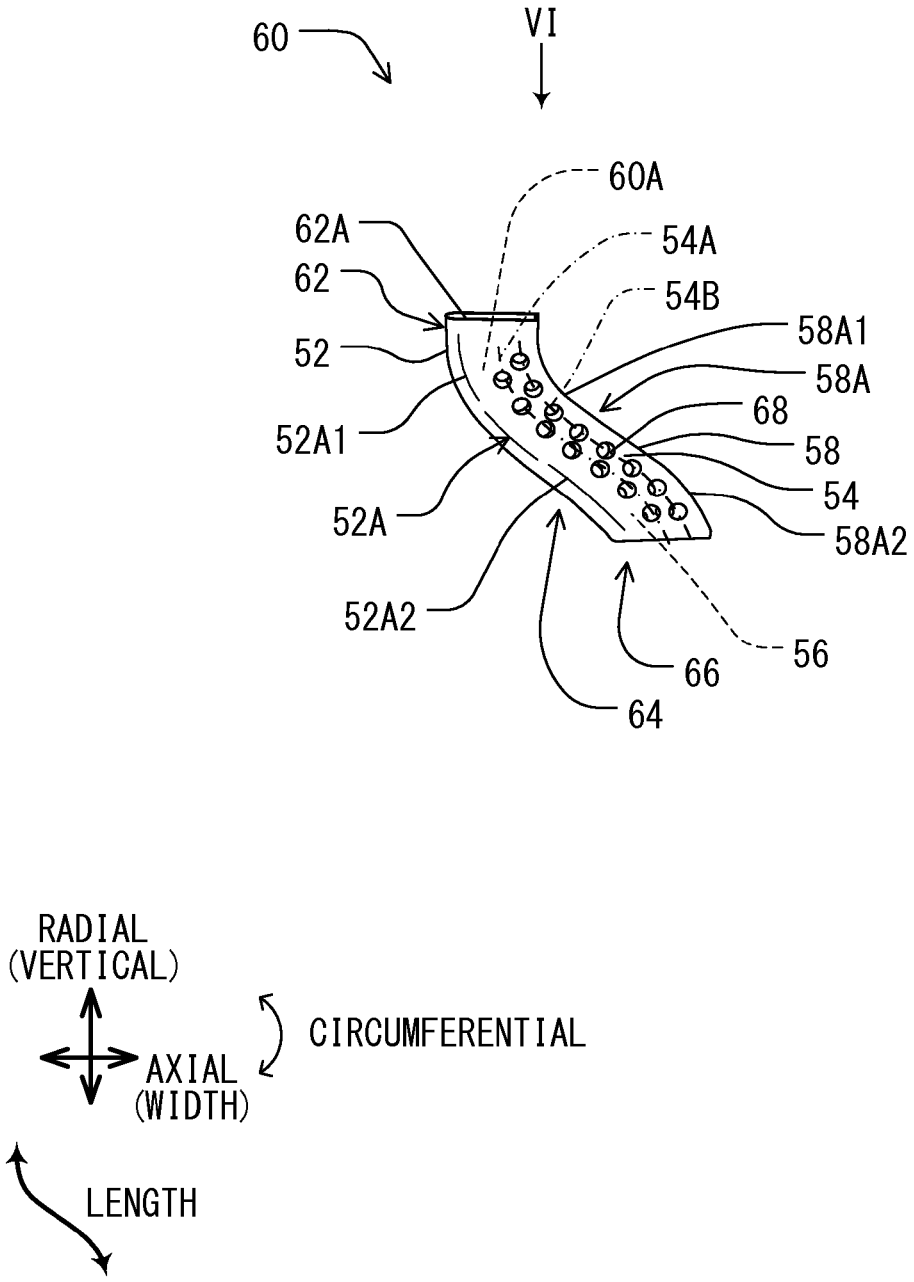
FIG. 5 is a view showing a diffusing device of the EGR device.

FIG. 5 is a side view showing the diffusing device 60. In FIG. 5, the upstream wall 52 and the lateral walls 54 and 56 form sidelines 52A therebetween. The lateral walls 54 and 56 and the downstream wall 58 form the sidelines 58A therebetween. Each of the sidelines 52A and 58A is defined by, for example, a combination of two or more arcs. In the present example, the sideline 52A includes an upper sideline 52A1 and a lower sideline 52A2, and the sideline 58A includes an upper sideline 58A1 and a lower sideline 58A2. Each of the upper sidelines 52A1 and 58A1 is in an arc shape convex downward (in one direction) in the drawing. Each of the lower sidelines 52A2 and 58A2 is in an arc shape convex upward (in another direction) in the drawing. The diffusing device 60 having the upper sidelines 52A1 and 58A1 and the lower sidelines 52A2 and 58A2 may form the interior 60A, which is bent twice from the root end 62 toward the tip end 66 while being twisted.

The lateral wall 54 has the through holes 68 arranged in two rows along imaginary lines 54A and 54B respectively. The lateral wall 56 has the through holes 68 arranged in two rows along imaginary lines (not shown) respectively, similarly to the lateral wall 54. That is, the through holes 68 are arranged substantially along the length direction of the diffusing device 60. Each of the imaginary lines 54A and 54B may be in parallel with the sidelines 52A and 58A. The through holes 68 adjacent to each other in the width direction are arranged alternately. That is, the through holes 68 are arranged in a zigzag form from the root end 62 toward the tip end 66.

Figure 6:
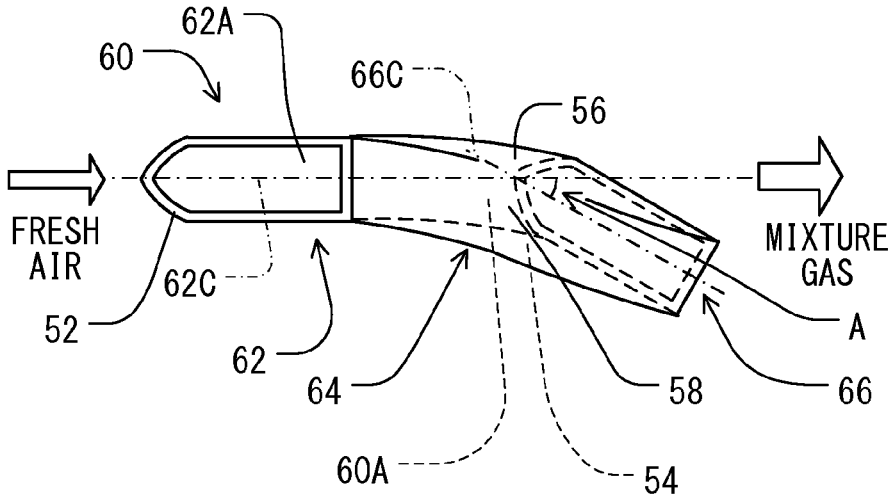
FIG. 6 is a schematic view showing the diffusing device viewed along the arrow VI in FIG. 5.
Figure 6:
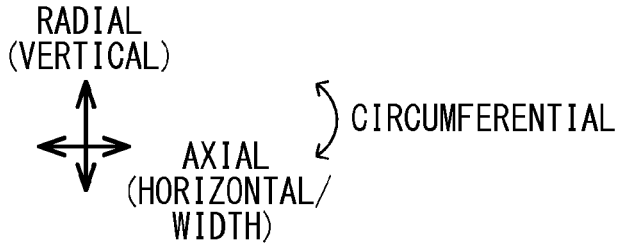

FIG. 6 is a schematic top view showing the diffusing device 60. In FIG. 6, the tip end 66 is hidden by the lateral walls 54 and 56 and the downstream wall 58 and is shown by dotted lines. In FIG. 6, through holes 68 are omitted. In the present example, the shape of the tip end 66 is substantially identical to the shape of the root end 62. The upstream wall 52 has a convex cross section projected toward the upstream side of fresh air. Each of the downstream wall 58 and the lateral walls 54 and 56 substantially has a flat cross section. In FIG. 6, the root end 62 has a centerline (root center) 62C shown by a chain line, and the tip end 66 has a centerline (tip center) 66C shown by a chain line. The tip center 66C is inclined relative to the root center 62C by a twisted angle A. The twisted angle A may be, for example, about 30 degrees. The twisted angle A may be in a range between 0 degree and 45 degree or may be in a range between 15 degree and 40 degree. The twisted angle A may be determined in consideration of a mixing effect of fresh air and EGR gas and blockage of the inner passage 42 caused by the lateral wall 54 faced to the upstream side of the mixture gas flow.

Figure 7:
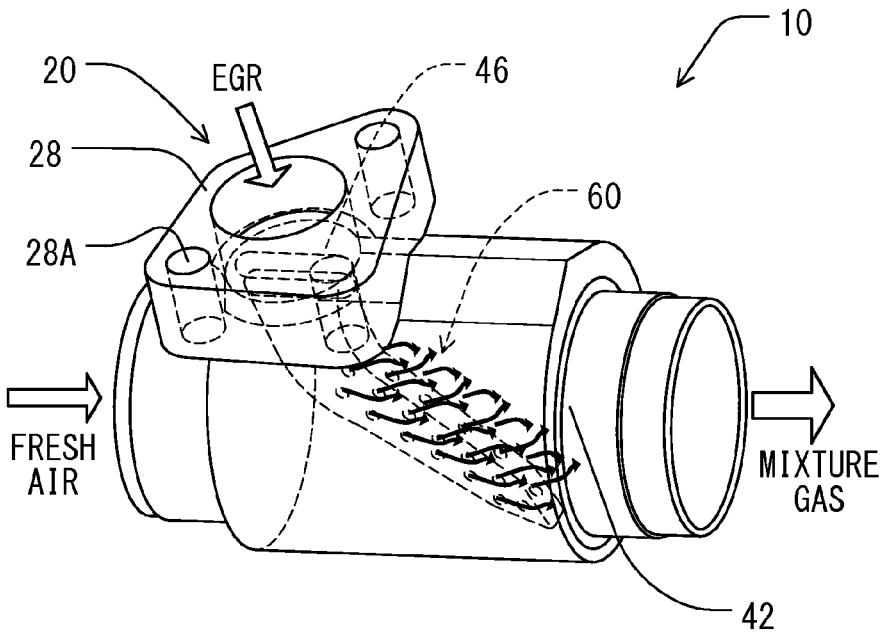
FIG. 7 is a perspective view showing the EGR device.
Figure 7:
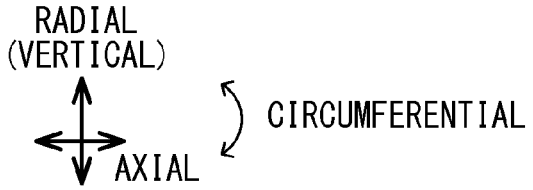

In FIG. 7, the EGR inlet 28 may have screw holes 28A screwed with the EGR passage 172. The present configuration enables to flow EGR gas from the EGR passage 172 (FIG. 1) to pass through the EGR channel 46 into the interior 60A of the diffusing device 60. The diffusing device 60 enables EGR gas to further flow from the interior 60A through the through holes 68 into the inner passage 42. The through holes 68 extend through the lateral walls 54 and 56 and the downstream wall 58 (FIG. 5). The present configuration enables to flow EGR gas from the interior 60A of the diffusing device 60 through the through holes 68 into the inner passage 42. After passing through the through holes 68, EGR gas may be expanded and diffused into fresh air passing through the inner passage 42. Thus, the present configuration may enable EGR gas to be homogeneously and evenly blended with fresh air in the inner passage 42 to produce uniform mixture gas.

The diffusing device 60 has the twisted configuration to form the interior 60A twisted from the upstream to the downstream in the flow direction. The present configuration may cause turbulence in the EGR gas flow through the interior 60A of the diffusing device 60 and through holes 68. In addition, the lateral walls 54 and 56 being twisted may deflect fresh air to cause turbulence in the fresh air.

In the present example, the upstream wall 52 does not have a through hole. Therefore, the upstream wall 52 may baffle EGR gas flow incoming from the opening 62A, thereby to reflect the EGR gas flow toward the lateral walls 54 and 56 and the downstream wall 58. In this way, the diffusing device 60 may rectify the EGR gas flow toward the downstream side lengthwise in the diffusing device 60. Thus, the diffusing device 60 may rectify the EGR gas flow and to diffuse EGR gas through the through holes 68. The diffusing device 60 may enable to lead EGR gas beyond the center of the inner passage 42 to the radially opposite side of the EGR channel 46. That is, the diffusing device 60 may enable EGR gas to access the opposite side of the diffusing device 60 from the EGR channel 46.

Second Embodiment

Figure 8:
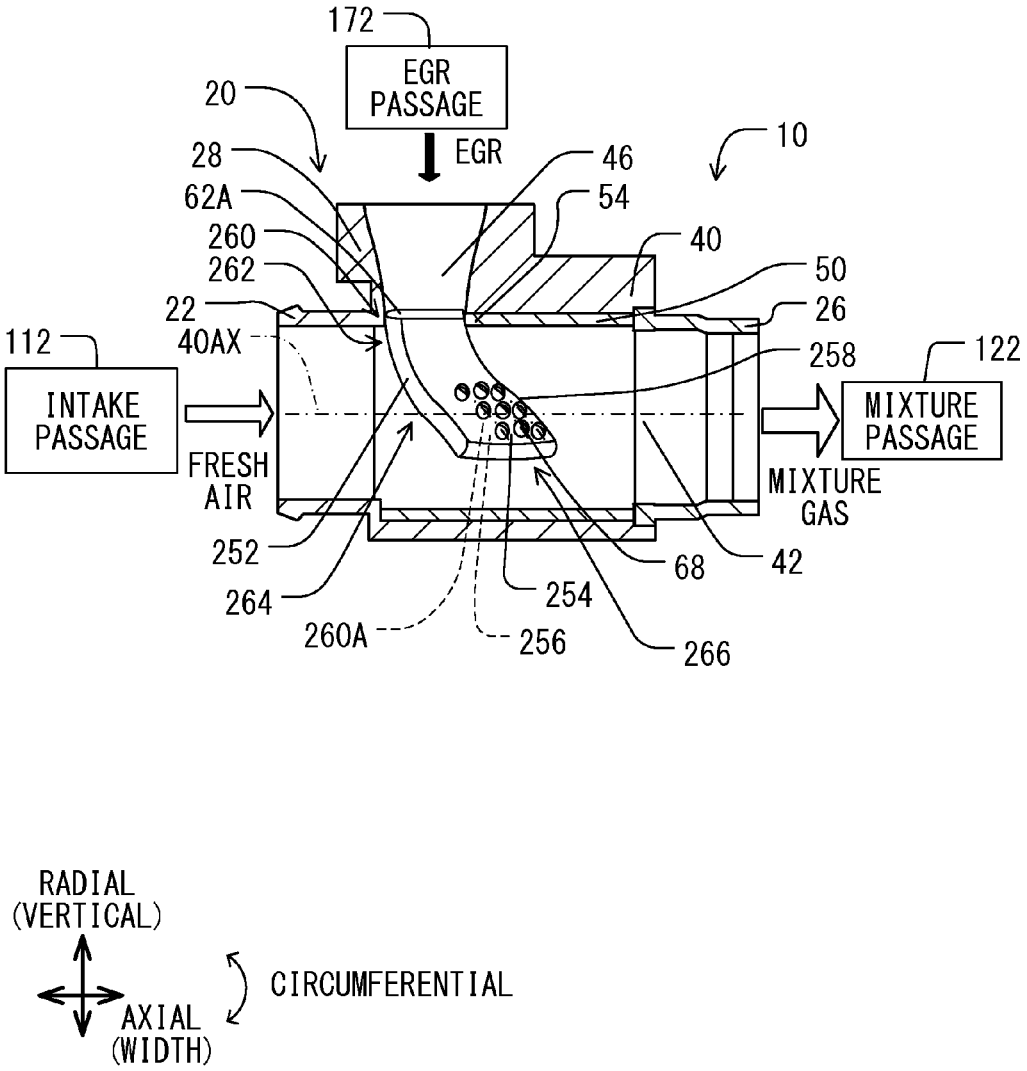
FIG. 8 is a partially sectional view showing an EGR device according to a second embodiment.

As shown in FIG. 8, according to the present second embodiment, a diffusing device 260 is shorter than the diffusing device 60 in the first embodiment. The housing 20 is substantially identical to that of the first embodiment.

The diffusing device 260 according to the present second embodiment extends to the center of the inner passage 42. The diffusing device 260 has a tip end 266 distant from the inner periphery of the housing body 40. The diffusing device 260 is cantilevered at a root end 262. The tip end 266 is located around the center axis 40AX of the housing body 40.

Similarly to the first embodiment, the diffusing device 260 has an intermediate portion 264 between the root end 262 and the tip end 266, and the intermediate portion 264 is formed with an upstream wall 252, lateral walls 254 and 256, and a downstream wall 258. The diffusing device 260 has a twisted configuration.

In the present example, the diffusing device 260 has through holes 68 selectively around the tip end 266. More specifically, the through holes 68 form an array centered around the center axis 40AX of the housing body 40. That is, the diffusing device 260 does not have the through holes 68 at the side of the root end 262. According to the present embodiment, the through holes 68 are selectively (mainly) formed around the tip end 66 located close to the center of the inner passage 42. The present configuration may concentrate the EGR gas flow around the center of the inner passage 42 to diffuse EGR gas radially from the center of the inner passage 42.

The through holes 68 are located selectively on the downstream side in the lateral walls 254 and 256. For example, in the lateral walls 254 and 256, the number of the through holes 68 on the downstream side may be larger than the number of the through holes 68 on the upstream side. For example, in the lateral walls 254 and 256, the through holes 68 may be located only on the downstream side relative to a center of the diffusing device 260 in the width direction.

Other Embodiment

The shape of the diffusing device is not limited to the above examples, and may be in various forms. The upper sideline and the lower sideline may not be arc lines and may be in various shapes.

The tip end may be different in shape from the root end. The tip end may be reduced in cross section relative to the root end.

Various combinations of the features such as the arrangement of the through holes and the twisted angle according to the above-described embodiments may be arbitrary employed.

The through holes may employ various forms. For example, the through holes may employ various numbers, various sizes, various arrangements, and/or various shapes. For example, the through holes may employ various shapes such as an oval shape, a polygonal shape, or a star shape. Various combinations of the through holes of the above-described embodiments may be arbitrary employed. The through holes may be unevenly arranged.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An EGR device comprising:

a housing defining an inner passage internally and having an EGR inlet; and a diffusing device extended from the EGR inlet into the inner passage, wherein the diffusing device is a hollow member having, a root end, a tip end, and an intermediate portion between the root end and the tip end defining an interior, the intermediate portion has a plurality of through holes communicating the interior with the inner passage, the tip end is twisted relative to the root end, and the intermediate portion includes lateral walls and a downstream wall located on the downstream side of the lateral walls and relative to mixture gas flow, wherein the lateral walls and downstream wall are projected inward into the inner passage so as to expose exteriors of the lateral walls and downstream wall to the fresh air or mixture gas flow.

2. The EGR device according to claim 1, wherein the lateral walls has at least one of the through holes.

3. The EGR device according to claim 1, wherein the downstream wall has at least one of the through holes.

4. The EGR device according to claim 1, wherein, the intermediate portion further includes an upstream wall located on the upstream side of lateral walls and relative to fresh air flow and the upstream wall defines a closed surface without the at least one of the through holes.

5. The EGR device according to claim 4, wherein the upstream wall has a cross section in a convex shape.

6. The EGR device according to claim 1, wherein the root end has a cross section having a root center, the tip end has a cross section having a tip center, and the root center is inclined at an angle relative to the tip center.

7. The EGR device according to claim 6, wherein the angle is between 5 degrees and 45 degrees.

8. The EGR device according to claim 1, wherein the EGR inlet defines an EGR channel internally, the root end has an opening, and the opening communicates the EGR channel with the interior of the diffusing device.

9. The EGR device according to claim 1, wherein the through holes are arranged lengthwise in a plurality of rows.

10. The EGR device according to claim 1, wherein the through holes are alternately arranged lengthwise.

11. The EGR device according to claim 1, wherein the housing has an inner periphery defining the inner passage, and the tip end is in contact with the inner periphery.

12. The EGR device according to claim 1, wherein the EGR inlet defines a funnel reduced in diameter into the opening.

13. The EGR device according to claim 1, wherein the housing has an inner periphery defining the inner passage, and the tip end is distant from the inner periphery.

14. The EGR device according to claim 13, wherein the tip end is located around a center of the inner passage.

15. The EGR device according to claim 1, wherein the through holes are located on a downstream side in the lateral walls.

16. The EGR device according to claim 14, wherein the through holes are located around a center of the inner passage.

17. An EGR mixer configured to be accommodated in a housing of an EGR device, the housing defining an inner passage internally and having an EGR inlet, the EGR mixer comprising:

a diffusing device body configured to be extended from the EGR inlet into the inner passage, wherein the diffusing device body is a hollow member having a root end, and a tip end, and an intermediate portion between the root end and the tip end defining an interior, the intermediate portion a plurality of through holes configured to communicate the interior with the inner passage, the tip end is twisted relative to the root end, and the intermediate portion includes lateral walls and a downstream wall located on the downstream side of the lateral walls and relative to mixture gas flow, wherein the lateral walls and downstream wall are projected inward into the inner passage so as to expose exteriors of the lateral walls and downstream wall to the fresh air or mixture gas flow.

18. The EGR device according to claim 1, wherein the diffusing device is inclined from the EGR inlet toward the downstream side so that the tip end is located downstream side of the root end.

19. The EGR mixer configured to be accommodated in a housing of an EGR device according to claim 17, wherein the diffusing device body is inclined from the EGR inlet toward the downstream side so that the tip end is located downstream side of the root end.

* * * * *